US010633854B1

(12) United States Patent
Zeigler, Jr.

(10) Patent No.: US 10,633,854 B1
(45) Date of Patent: Apr. 28, 2020

(54) EXTERIOR DRAIN FOR EXTERIOR WALL PANEL SYSTEM

(71) Applicant: Harvey J. Zeigler, Jr., Perkinston, MS (US)

(72) Inventor: Harvey J. Zeigler, Jr., Perkinston, MS (US)

( * ) Notice: Subject to any disclaimer, the term of this patent is extended or adjusted under 35 U.S.C. 154(b) by 0 days.

(21) Appl. No.: 16/401,954

(22) Filed: May 2, 2019

(51) Int. Cl.
*E04B 1/70* (2006.01)
*E04C 2/52* (2006.01)

(52) U.S. Cl.
CPC . *E04B 1/70* (2013.01); *E04C 2/52* (2013.01)

(58) Field of Classification Search
CPC ..... E04B 1/70; E04C 2/52
USPC ..... 52/220.1
See application file for complete search history.

(56) References Cited

U.S. PATENT DOCUMENTS 1,746,816 A 2/1930 Boes
3,850,193 A * 11/1974 Guzzo ..... E02D 29/16 137/362
4,271,648 A * 6/1981 Johnson ..... E04B 1/7023 52/169.5
4,666,334 A * 5/1987 Karaus ..... E02B 3/04 405/31
4,748,007 A * 5/1988 Gaudion ..... A61B 1/121 134/170
5,115,614 A 5/1992 McGrath
5,274,968 A 1/1994 Pardo
5,768,842 A * 6/1998 Austin ..... A47K 3/008 4/546
6,298,620 B1 * 10/2001 Hatzinikolas ..... E04B 1/70 52/302.1
6,604,891 B1 * 8/2003 Wurster ..... E02D 29/02 405/262
8,919,062 B1 * 12/2014 Viness ..... E04F 13/04 52/220.5
10,519,619 B2 * 12/2019 Kondas ..... E03F 1/002
2002/0108333 A1 * 8/2002 Clayton ..... E04B 1/70 52/302.1
2007/0044402 A1 3/2007 Hess
2011/0173909 A1 * 7/2011 Viau ..... B44C 5/0415 52/302.1
2013/0126536 A1 * 5/2013 Santy ..... B65D 1/34 220/571
2015/0047281 A1 * 2/2015 Cole ..... E04F 13/148 52/302.1

* cited by examiner

*Primary Examiner* — Jeanette E Chapman
(74) *Attorney, Agent, or Firm* — George L Williamson

(57) ABSTRACT

Method and apparatus for a rectangular shaped body which forms a receiver for moisture that collects in or about the drainage plane behind an Exterior Insulation and Finish System which receiver collects the water and allows the water to drain away from the wall system to the outside of the finished wall through at least one drainage tube. The receiver body is expected to be installed behind the Expanded Polystyrene on front of the exterior surface of the interior sheathing.

12 Claims, 3 Drawing Sheets

EXTERIOR DRAIN FOR EXTERIOR WALL PANEL SYSTEM

BACKGROUND OF THE INVENTION

Field of the Invention

The present invention relates generally to wall systems and appurtenances and, more particularly, is concerned with a drainage system for a exterior wall panel system.

Description of the Related Art

Devices relevant to the present invention have been described in the related art; however, none of the related art devices disclose the unique features of the present invention.

In U.S. Pat. No. 8,919,062 dated Dec. 30, 2014, Viness, et al., disclosed an exterior wall panel system. In U.S. Patent Application Publication No. 2007/0044402 dated Mar. 1, 2007, Hess disclosed a moisture control system. In U.S. Pat. No. 1,746,816 dated Feb. 11, 1930, Boes disclosed a building construction. In U.S. Pat. No. 5,274,968 dated Jan. 4, 1994, Pardo disclosed a building block for use with flashing and arrangement for weeping condensation. In U.S. Pat. No. 5,115,614 dated May 26, 1992, McGrath disclosed a masonry unit with integral flashing.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a rectangular shaped body which forms a receiver for moisture that collects in or about the drainage plane behind an Exterior Insulation and Finish System (EIFS) which receiver collects the water and allows the water to drain away from the wall system to the outside of the finished wall through at least one drainage tube or conduit which is disposed on the receiver body. The body can be made in a variety of sizes including lengths, thicknesses, and heights and is expected to be disposed on a lower portion of the EIFS wall panel system near the drainage plane so that the water that forms or collects at the drainage plane can be quickly expelled from the interior of the EIFS to its outside. The receiver body is expected to be installed behind the Expanded Polystyrene (EPS) on top of the exterior surface of the interior sheathing. EPS is a lightweight, rigid, closed-cell insulation which is found in a multitude of shapes and applications. It is commonly used for packaging of electrical consumer goods and for insulation panels for buildings.

An object of the present invention is to provide a receiver body which has an inlet for collecting moisture from behind an EIFS wall panel system. A further object of the present invention is to provide a receiver body that has at least one drain tube and possibly a plurality of drain tubes for transporting water from the interior of an EIFS wall panel system to the outside. A further object of the present invention is to provide a receiver body that can be easily made and manufactured in a variety of sizes and shapes so that it can be adapted to any type of EFS wall panel systems to remove moisture from the interior thereof. A further object of the present invention is to provide a receiver body that can be easily installed and operated by a user. A further object of the present invention is to provide a receiver body that can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
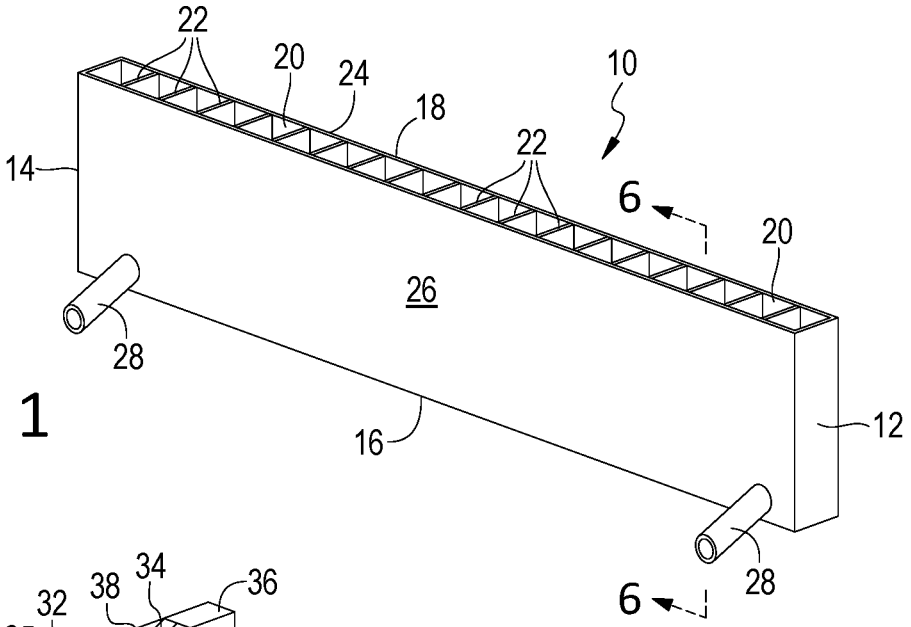
FIG. 1 is a perspective view of the present invention.

With regard to reference numerals used, the following numbering is used throughout the drawings.

10 present invention
12 right hand wall
14 left hand wall
16 lower bottom end
18 upper end
20 openings
22 divider walls
24 rear wall
26 front wall
28 drainage tubes
30 EIFS wall panel system
32 EPS foam
34 sheathing layer
35 outer layer
36 metal stud framing
38 drainage plane
40 space
42 outside of EIFS wall panel system
44 moisture
46 caulk joint

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 6 illustrate the present invention wherein a receiver body for removing moisture from behind an EIFS wall panel system is disclosed and which is generally indicated by reference number 10.

Turning to FIG. 1, therein is shown a perspective view of the present invention 10 wherein a receiver body expected to be made of plastic is shown wherein the body is designed to collect moisture at the drainage plane behind a prefabricated EIFS wall panel system and which body allows moisture to drain toward the outside of the finish wall. The present invention 10 is expected to be installed behind the EPS foam on either the outside or top of the exterior wall sheathing.

The present invention 10 includes a left and right end wall 12, 14 along with a bottom wall 16 and an upper side 18 having a plurality of openings 20 therein which are formed by a series of cross walls 22 running between a rear wall 24 and a forward wall 26 which form the plurality of side by side openings 20. On the front wall 26 near the lower end 16 are a pair of drainage tubes 28 being at least one in number but expected to be a plurality thereof. The drainage tubes or conduits 28 are sized to accommodate the flow of moisture from the present invention 10 depending on the size and shape of the present invention 10 which is installed in the particular job site so as to insure that the drainage tubes 28 are properly sized to effectively drain all of the moisture that collects on the interior of the drainage body of the present invention 10. The present invention 10 is expected to be made of plastic or similar material and its size and shape are to be user selected based on the particular installation and may be installed as a rather long single member, for example, approximately 10 feet long, or it can be comprised of a series of shorter members, for example, 6 inches long, disposed in a side by side relationship to cover the entire width of the particular wall panel system in which it is installed.

Figure 2:
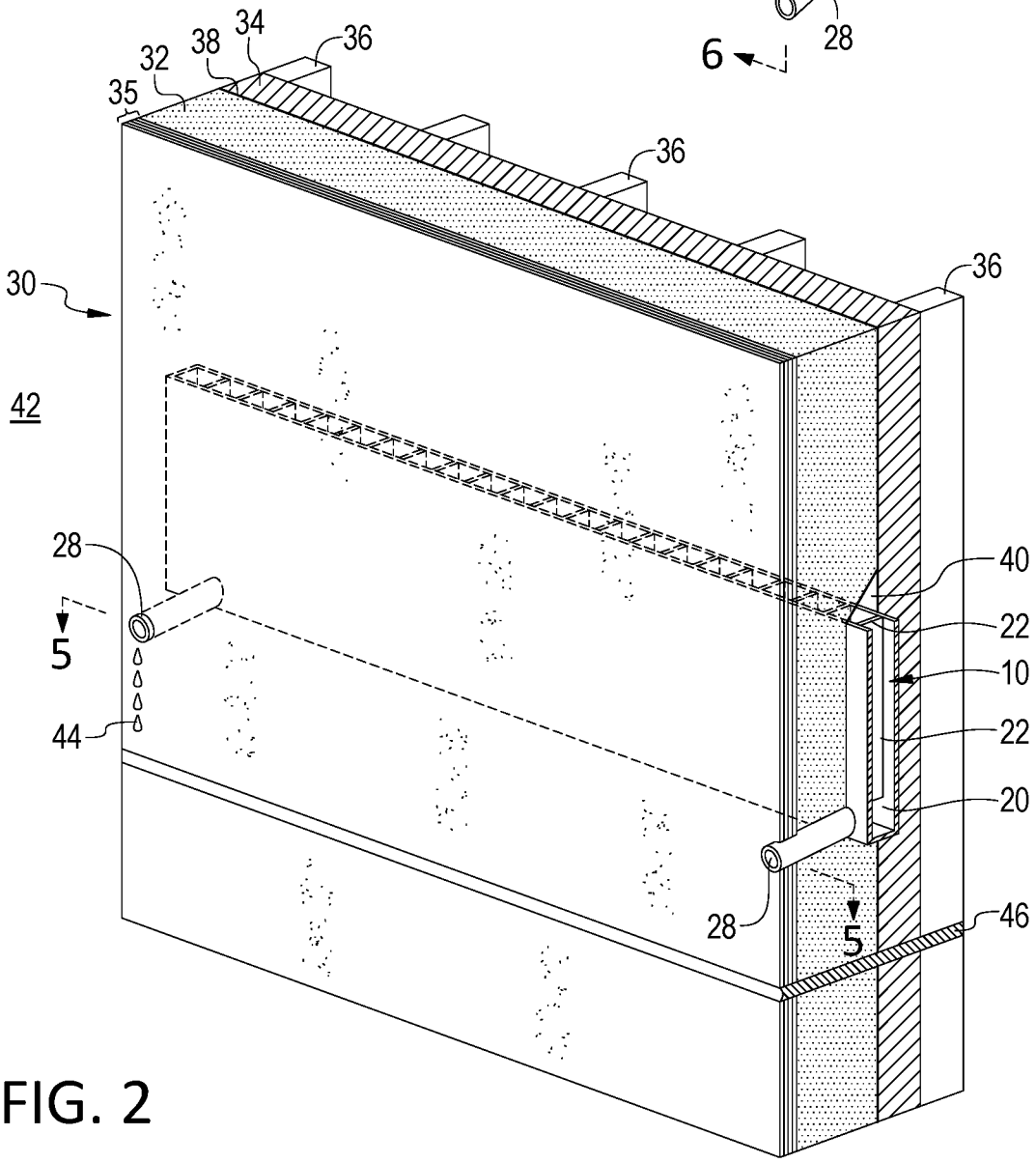
FIG. 2 is a perspective view of the present invention shown in operative connection.

Turning to FIG. 2, therein is shown by general reference number 30 the EIFS wall panel system including an outer layer of EPS foam 32, an inner layer of sheathing 34 and a layer being wall stud framing 36 wherein a drainage plane 38 is disposed between the EPS layer 32 and the sheathing 34 wherein the present invention 10 is disposed in a moisture collection space 40 formed between the EPS foam 32 and the sheathing layer 34 where the space is effectively sized to allow the present invention 10 to be disposed therein so that the drainage tubes 28 can be extended toward the outside 42 of the EIFS wall panel system 30 so that any collected moisture 44 can be effectively removed from the EIFS wall panel system 30. Caulked joint 46 is also shown at the point of joinder between upper and lower sections of EIFS. Of course, the caulked joint 46 is shown only to help illustrate the environment of the present invention 10 and has nothing to do with the operation or structure of the present invention 10. Outer layer 35, may include reinforcing mesh, a base coat which forms the inner portion of the outer moisture barrier, or a finish coat, which forms the outer portion of the outer moisture barrier. While these layers 35 are important to an EIFS system, they are not particularly relevant to the present invention 10 because the present invention 10 can be used with or without these layers. Therefore, these layers are shown grouped together as a general outer layer 35. The present invention 10 could be used in and would effectively drain any type of wall panel system which included a drainage plane 38 as disclosed herein.

Figure 3:
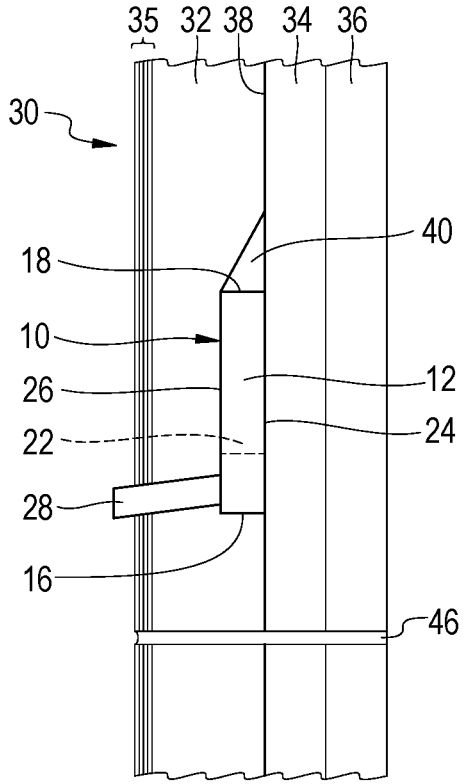
FIG. 3 is a side elevation view of the present invention shown in operative connection.

Turning to FIG. 3, therein are shown the previously disclosed elements of the present invention 10 showing it disposed between layers 32, 34 in the drainage plane 38 so that it can collect moisture in the moisture collecting space 40 then have the moisture pass through the interior of the present invention 10 and out the drainage conduit/tube 28. The moisture collection space 40 is clearly shown and is effectively sized to collect the moisture between layers 32 and 34 and thereby allow the moisture to enter into the present invention 10. The drainage tubes 28 are shown having an effective slope and length to allow passage of the moisture through the tubes and to the outside of the EIFS wall panel system.

Figure 4:
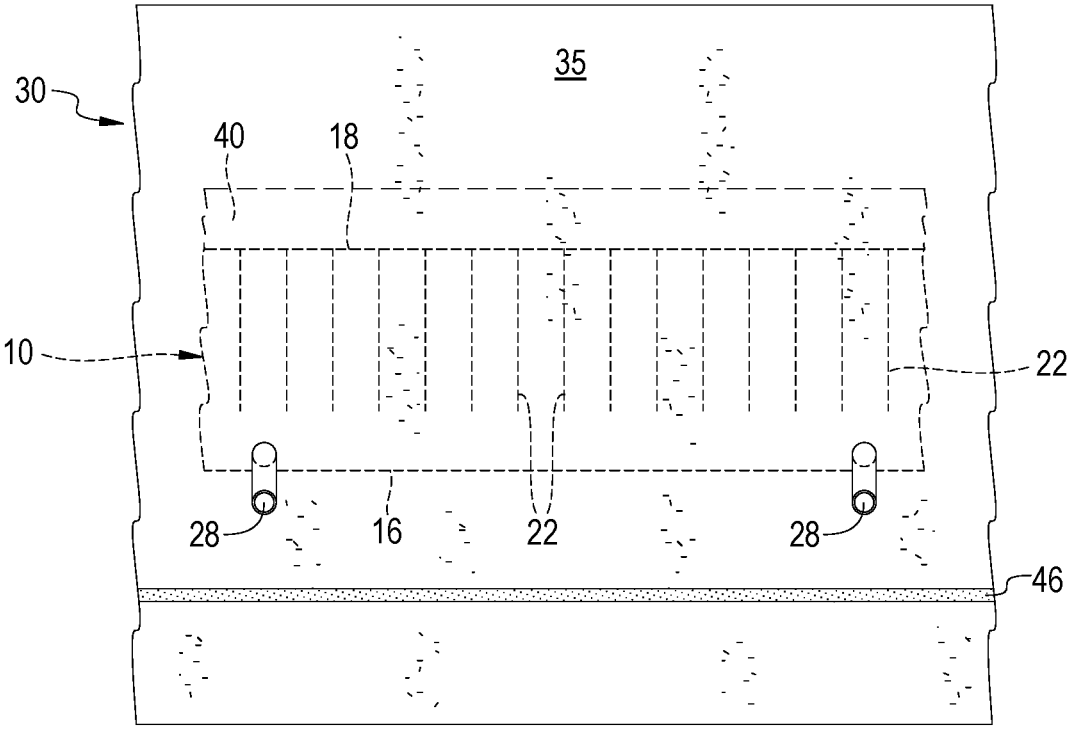
FIG. 4 is a front elevation view of the present invention shown in operative connection.

Turning to FIG. 4, therein is shown the present invention 10 along with the previously disclosed elements. It should be clear that the present invention 10 could be made as a single elongated member, for example, being approximately 8-10 feet long, or could be comprised of a series of shorter members, for example, 6-12 inches long, disposed in a side-by-side relationship so as to cover the entire width of the particular wall panel system in which it is installed. The cut lines on each end of the present invention 10 are intended to illustrate this in FIG. 4 by showing that it is of indeterminate length and therefore being variable in length.

Figure 5:
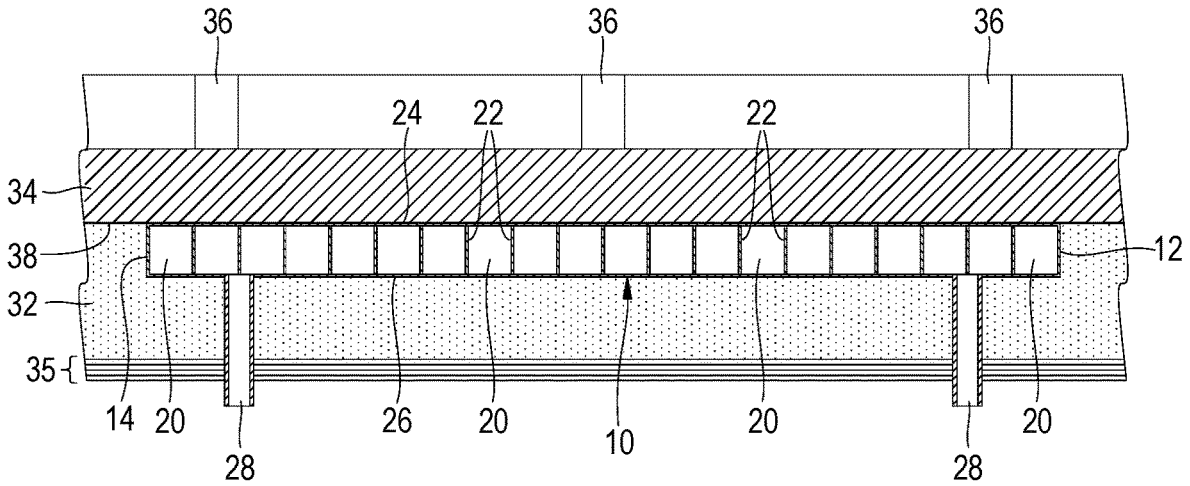
FIG. 5 is a cross-sectional view taken from FIG. 2 as indicated.

Turning to FIG. 5, therein is shown the present invention 10 including previously disclosed elements and particularly showing that the present invention 10 has a plurality of openings 20 separated by divider walls 22 being disposed in a side-by-side relationship so as to form and be spread across the entire width of the present invention 10 whether the present invention 10 is formed of a single rather long structure, for example, being 8 to 10 feet long, are a short structure, for example, being 6-12 inches long, the present invention 10 would be constructed in the same manner. It also should be clear that the present invention 10 is disposed proximate the drainage plane 38 between the layers 32 and 34 of the EIFS wall panel system.

Figure 6:
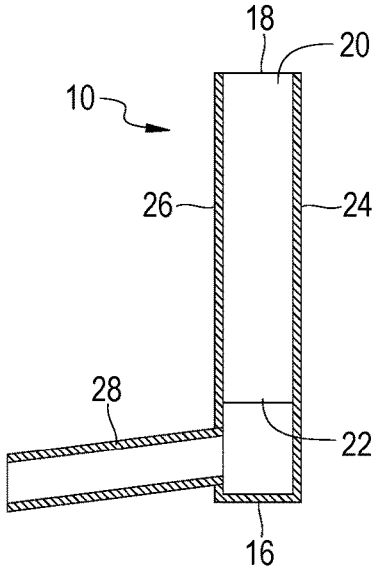
FIG. 6 is a cross-sectional view taken from FIG. 1 as indicated.

Turning to FIG. 6, therein is shown the present invention 10 particularly illustrating that the drainage tubes 28 are effectively slope downwardly so that they will effectively remove moisture which collects in the collection chamber on the interior of the present invention 10. The collection chamber is disposed in the area between the lower terminus of the divider walls 22 and the bottom 16 on the inside of the receiver body 10 adjacent the inlet to the drainage tubes 28.

By way of general explanation and by making reference to FIGS. 1-6, the present invention 10 may be summarized as follows: a method of collecting and removing moisture from an external wall panel system 30 of a building, having the steps of: a) providing the external wall panel system of a building comprising metal stud framing 36 formed by vertically extended spaced stud members, a sheathing layer 34 covering outer edges of the stud members, an outer layer of a rigid closed-cell insulation 32 on an outer surface of the sheathing layer, and a general outer layer 35 covering the insulation; b) a user inserting a receiver body 10 into the wall panel system for removing moisture 44 from an interior of the wall panel system, the receiver body being mounted in a drainage plane 38 between the insulation and the sheathing layer and comprising a rear wall 24 abutting the sheathing layer, a forward wall 26 spaced from the rear wall, with side walls 12, 14, an open top 20, and bottom wall 16 forming an interior of the receiver body; c) forming inside of the receiver body a series of spaced, vertically extending cross walls 22 between the forward and rear walls within the receiver body extending down from a top of the receiver body forming vertical passageways, the cross walls terminating short of the bottom wall forming a collection chamber along the bottom wall; d) forming a collection space 40 in the insulation above the receiver body for allowing moisture to enter top openings into the receiver body; and e) inserting one or more drainage tubes 28 into and extending out from the collection chamber through the forward wall and general outer layer of the wall panel system for draining moisture that collects on the interior of the receiver body. The receiver body 10 of the present invention may be manufactured in many sizes and may be as small as about 3" in height, i.e., the height of the rear wall 24, with a thickness (distance between front 26 and rear 24 walls) of about ⅜ ", wherein the drainage tubes 28 are about ½" in diameter and spaced about 2" apart (side to side), with the divider walls 22 being spaced about ½" apart (side to side).

I claim:

1. A moisture collector system, comprising:

a) an external wall panel system of a building comprising metal stud framing formed by vertically extended spaced stud members, a sheathing layer covering outer edges of said stud members, an outer layer of a rigid closed-cell insulation on an outer surface of said sheathing layer, and a general outer layer covering said insulation;

b) a receiver body for removing moisture from an interior of said wall panel system mounted in a drainage plane between said insulation and said sheathing layer, said receiver body being completely on a lower portion of said exterior wall panel system;

c) said receiver body comprising a rear wall abutting said sheathing layer, a forward wall spaced from said rear wall, with side walls, an open top, and bottom wall forming an interior of said receiver body;

d) a series of spaced, vertically extending cross walls between said forward and rear walls within said receiver body extending down from a top of said receiver body forming top openings for downwardly extending vertical passageways, said cross walls terminating short of said bottom wall forming a collection chamber along said bottom wall;

e) a well defined collection space formed in said insulation directly above said receiver body communicating directly with said top openings for allowing moisture to enter said vertical passageways in said receiver body; and f) one or more drainage tubes extending from said collection chamber below bottom ends of said vertically extending cross walls out through said forward wall and general outer layer of said wall panel system for draining moisture that collects on the interior of said receiver body.

2. The moisture collection system of claim 1, in which said receiver body is made of plastic.

3. The moisture collection system of claim 1, in which said receiver body extends a full width of said external wall panel system.

4. The moisture collection system of claim 1, in which said receiver body comprises a series of members disposed in a side by side relationship to cover an entire width of said external wall panel system.

5. The moisture collection system of claim 1, in which said general outer layer includes a reinforcing mesh, a base coat, and a finish coat.

6. The moisture collection system of claim 1, in which said drainage tubes are sloped downwardly sufficiently effective to remove moisture collected in said collection chamber.

7. A method of collecting and removing moisture from an external wall panel system of a building, comprising the steps of:

a) providing the external wall panel system of a building comprising metal stud framing formed by vertically extended spaced stud members, a sheathing layer covering outer edges of the stud members, an outer layer of a rigid closed-cell insulation on an outer surface of the sheathing layer, and a general outer layer covering the insulation;

b) a user inserting a receiver body completely into a lower portion of the wall panel system for removing moisture from an interior of the wall panel system, the receiver body being mounted in a space formed in the insulation adjacent the sheathing layer and comprising a rear wall abutting the sheathing layer, a forward wall spaced from the rear wall, with side walls, an open top, and bottom wall forming an interior of the receiver body;

c) forming inside of the receiver body a series of spaced, vertically extending cross walls between the forward and rear walls within the receiver body extending down from a top of the receiver body forming top openings for vertical passageways, the cross walls terminating short of the bottom wall forming a collection chamber along the bottom wall;

d) forming a well defined collection space in the insulation directly above the receiver body communicating directly with said top openings for allowing moisture to enter said top openings into the receiver body; and e) inserting one or more drainage tubes into and extending out from the collection chamber through the forward wall and general outer layer of the wall panel system below bottom ends of said vertically extending cross walls for draining moisture that collects on the interior of the receiver body.

8. The method of claim 7, in which the receiver body is made of plastic.

9. The method of claim 7, in which the receiver body extends a full width of the external wall panel system.

10. The method of claim 7, in which the receiver body comprises a series of members disposed in a side by side relationship to cover an entire width of the external wall panel system.

11. The method of claim 7, in which the general outer layer includes a reinforcing mesh, a base coat, and a finish coat.

12. The method of claim 7, in which the drainage tubes are sloped downwardly sufficiently effective to remove moisture collected in the collection chamber.

* * * * *